US007578354B2

(12) United States Patent
Thomson

(10) Patent No.: US 7,578,354 B2
(45) Date of Patent: Aug. 25, 2009

(54) DEVICE AND METHOD TO SEAL BOREHOLES

(75) Inventor: Neil Thomson, The Hague (NL)

(73) Assignee: E2Tech Limited, The Hague (NL)

( * ) Notice: Subject to any disclaimer, the term of this patent is extended or adjusted under 35 U.S.C. 154(b) by 0 days.

(21) Appl. No.: 11/761,283

(22) Filed: Jun. 11, 2007

(65) Prior Publication Data

US 2008/0000646 A1 Jan. 3, 2008

Related U.S. Application Data

(63) Continuation of application No. 10/470,199, filed as application No. PCT/GB02/00362 on Jan. 28, 2002, now Pat. No. 7,228,915.

(30) Foreign Application Priority Data

Jan. 26, 2001 (GB) ..... 0102023.9
Feb. 1, 2001 (GB) ..... 0102526.1

(51) Int. Cl.
*E21B 33/12* (2006.01)

(52) U.S. Cl. ..... 166/387; 166/207; 277/322; 277/934; 277/944

(58) Field of Classification Search ..... 166/387, 166/207, 191, 297, 384, 55, 179, 187; 277/322, 277/944–946, 934
See application file for complete search history.

(56) References Cited

U.S. PATENT DOCUMENTS 1,525,368 A * 2/1925 Cameron ..... 166/124
2,069,212 A * 2/1937 Buffington ..... 277/439
2,814,947 A 12/1957 Stegemeier et al.
2,945,541 A 7/1960 Maly et al.
3,385,367 A * 5/1968 Kollsman ..... 166/191
3,509,016 A 4/1970 Underwood et al.
3,740,360 A 6/1973 Nimerick
3,918,523 A 11/1975 Stuber (Continued)

FOREIGN PATENT DOCUMENTS

EP 0 283 090 1/1993

(Continued)

OTHER PUBLICATIONS

Rubbo, Richard P., What to Consider When Designing Downhole Seals, World Oil, Exploration Drilling Production, Guide to Drilling, Completion and Workover Fluids, Jun. 1987, pp. 78-83.

(Continued)

*Primary Examiner*—Kenneth Thompson
(74) *Attorney, Agent, or Firm*—Patterson & Sheridan, L.L.P.

(57) ABSTRACT

Apparatus and methods are described that are particularly suited for creating a seal in a borehole annulus. In one embodiment, an outer surface 10*s* of an expandable conduit 10 is provided with a formation 20 that includes an elastomeric material (e.g. a rubber) that can expand and/or swell when the material comes into contact with an actuating agent (e.g. water, brine, drilling fluid etc.). The expandable conduit 10 is located inside a second conduit (e.g. a pre-installed casing, liner or open borehole) and radially expanded. The actuating agent can be naturally occurring in the borehole or can be injected or pumped therein to expand or swell the elastomeric material to create the seal.

28 Claims, 2 Drawing Sheets

U.S. PATENT DOCUMENTS

| | | | | |
|---|---|---|---|---|
| 4,008,353 | A | 2/1977 | Gross et al. | |
| 4,041,231 | A | 8/1977 | Gross et al. | |
| 4,058,124 | A | 11/1977 | Yen et al. | |
| 4,059,552 | A | 11/1977 | Zweigle et al. | |
| 4,137,970 | A | 2/1979 | Laflin et al. | |
| 4,138,382 | A | 2/1979 | Polmanteer | |
| 4,172,066 | A | 10/1979 | Zweigle et al. | |
| 4,612,985 | A | 9/1986 | Rubbo et al. | |
| 4,820,560 | A | 4/1989 | Buchwald et al. | |
| 4,836,940 | A | 6/1989 | Alexander | |
| 4,862,967 | A | 9/1989 | Harris | |
| 4,895,909 | A | 1/1990 | Sypniewski | |
| 4,919,989 | A | 4/1990 | Colangelo | |
| 4,936,386 | A | 6/1990 | Colangelo | |
| 5,048,605 | A | 9/1991 | Toon et al. | |
| 5,086,841 | A | 2/1992 | Reid et al. | |
| 5,126,400 | A | 6/1992 | Graiver et al. | |
| 5,191,173 | A | 3/1993 | Sizer et al. | |
| 5,195,583 | A | 3/1993 | Toon et al. | |
| 5,374,684 | A | 12/1994 | Tai | |
| 5,416,160 | A | 5/1995 | Johnson | |
| 5,423,630 | A * | 6/1995 | Imoto et al. | 405/184.2 |
| 5,611,400 | A | 3/1997 | James et al. | |
| 5,657,822 | A | 8/1997 | James et al. | |
| 5,810,085 | A | 9/1998 | James et al. | |
| 5,821,452 | A | 10/1998 | Neuroth et al. | |
| 6,358,580 | B1 | 3/2002 | Mang et al. | |
| 6,431,282 | B1 | 8/2002 | Bosma et al. | |
| 6,581,682 | B1 | 6/2003 | Parent et al. | |
| 6,820,690 | B2 * | 11/2004 | Vercaemer et al. | 166/277 |
| 6,834,725 | B2 | 12/2004 | Whanger et al. | |
| 6,840,325 | B2 | 1/2005 | Stephenson | |
| 6,854,522 | B2 | 2/2005 | Brezinski et al. | |
| 6,935,432 | B2 | 8/2005 | Nguyen | |
| 7,013,979 | B2 | 3/2006 | Richard | |
| 7,059,415 | B2 | 6/2006 | Bosma et al. | |
| 7,143,832 | B2 | 12/2006 | Freyer | |
| 7,228,915 | B2 * | 6/2007 | Thomson | 166/387 |
| 2003/0070811 | A1 * | 4/2003 | Robison et al. | 166/298 |
| 2003/0075323 | A1 | 4/2003 | Vercaemer et al. | |
| 2004/0020662 | A1 * | 2/2004 | Freyer | 166/387 |
| 2004/0112609 | A1 | 6/2004 | Whanger et al. | |
| 2004/0118572 | A1 | 6/2004 | Whanger et al. | |
| 2004/0231861 | A1 | 11/2004 | Whanger et al. | |
| 2005/0067170 | A1 | 3/2005 | Richard | |
| 2007/0151723 | A1 | 7/2007 | Freyer | |

FOREIGN PATENT DOCUMENTS

| | | |
|---|---|---|
| EP | 0 629 259 | 4/1997 |
| EP | 0 768 330 | 4/1997 |
| EP | 0 778 811 | 5/2001 |
| EP | 1 165 719 | 11/2003 |
| GB | 797791 | 7/1958 |
| GB | 925292 | 5/1963 |
| JP | 04-363499 | 12/1992 |
| JP | 09-151686 | 6/1997 |
| JP | 2000-064764 | 2/2000 |
| WO | WO 93/18274 | 9/1993 |
| WO | WO 99/23401 | 5/1999 |
| WO | WO 00/37766 | 6/2000 |
| WO | WO 00/60017 | 10/2000 |
| WO | WO 01/21998 | 3/2001 |

OTHER PUBLICATIONS

E.P.Fowler and T.E. Taylor, How to Select and Test Materials for -75, World Oil 1976, pp. 65-66.

* cited by examiner

DEVICE AND METHOD TO SEAL BOREHOLES

CROSS-REFERENCE TO RELATED APPLICATIONS

This application is a continuation of U.S. patent application Ser. No. 10/470,199, filed May 21, 2004, now U.S. Pat. No. 7,228,915 which was the national stage of PCT International Application No. PCT/GB02/00362, filed Jan. 28, 2002, which claims benefit of Great Britain Application No. 0102023.9, filed Jan. 26, 2001, and Great Britain Application No. 0102526.1, filed Feb. 1, 2001. Each of the aforementioned related patent applications is herein incorporated by reference in its entirety.

BACKGROUND OF THE INVENTION

Field of the Invention

The present invention relates to apparatus and methods for sealing an annulus in a borehole. The present invention can also be used to seal and lock expandable tubular members within cased, lined, and in particular, open-hole boreholes.

SUMMARY OF THE INVENTION

It is known to use expandable tubular members, e.g. liners, casing and the like, that are located in a borehole and radially expanded in situ by applying a radial expansion force using a mechanical expander device or an inflatable element, such as a packer. Once the expandable member has been expanded into place, the member may not contact the conduit (e.g. liner, casing, formation) in which it is located along the entire length of the member, and a seal is generally required against the liner, casing or formation to prevent fluid flow in an annulus created between the expandable member and the liner, casing or formation, and also to hold differential pressure. The seal also helps to prevent movement of the expandable member that may be caused by, for example, expansion or contraction of the member or other tubular members within the borehole, and/or accidental impacts or shocks.

When running and expanding in open-hole applications or within damaged or washed-out casing, liner etc, the diameter of the borehole or the casing, liner etc may not be precisely known as it may vary over the length of the borehole because of variations in the different materials in the formation, or variations in the internal diameter of the downhole tubulars. In certain downhole formations such as washed-out sandstone, the size of the drilled borehole can vary to a large extent along the length or depth thereof.

According to a first aspect of the present invention, there is provided a seal for use in a borehole, the seal comprising an elastomeric material that is capable of expanding upon contact with an actuating agent.

According to a second aspect of the present invention, there is provided a method of creating a seal in a borehole, the method comprising the steps of providing an elastomeric material in the borehole and exposing the material to an actuating agent that causes the elastomeric material to expand.

The seal is preferably expanded in an annulus to seal the annulus or a portion thereof.

The elastomeric material is typically a rubber. The elastomeric material can be NITRILE™, VITON™, AFLAS™, Ethylene-propylene rubbers (EPM or EPDM) or KALREZ™, although other suitable materials may also be used.

Any elastomeric material may be used. The choice of elastomeric material will largely depend upon the particular application and the actuating agent. Also, the fluids that are present downhole will also determine which elastomeric material or actuating agent can be used.

The actuating agent typically comprises a water- or mineral-based oil or water. Production and/or drilling fluids (e.g. brine, drilling mud or the like) may also be used. Hydraulic oil may be used as the actuating agent. Any fluid that reacts with a particular elastomeric material may be used as the actuating agent. The choice of actuating agent will depend upon the particular application, the elastomeric material and the fluids that are present downhole.

The actuating agent may be naturally occurring downhole, or can be injected or pumped into the borehole. Alternatively, a container (e.g. a bag) of the actuating agent can be located at or near the elastomeric material where the container bursts upon radial expansion of the conduit. Thus, the actuating agent comes into contact with the elastomeric material causing it to expand and/or swell.

The elastomeric material is typically applied to an outer surface of a conduit. The conduit can be any downhole tubular, such as drill pipe, liner, casing or the like. The conduit is preferably capable of being radially expanded, and is thus typically of a ductile material.

The conduit can be a discrete length or can be in the form of a string where two or more conduits are coupled together (e.g. by welding, screw threads etc). The elastomeric material can be applied at two or more axially spaced-apart locations on the conduit. The elastomeric material is typically applied at a plurality of axially spaced-apart locations on the conduit.

The conduit is typically radially expanded. The conduit is typically located in a second conduit before being radially expanded. The second conduit can be a borehole, casing, liner or other downhole tubular.

The elastomeric material can be at least partially covered or encased in a non-swelling and/or non-expanding elastomeric material. The non-swelling and/or non-expanding elastomeric material can be an elastomer that swells in a particular fluid that is not added or injected into the borehole, or is not naturally occurring in the borehole. Alternatively, the non-swelling and/or non-expanding elastomeric material can be an elastomer that swells to a lesser extent in the naturally occurring, added or injected fluid.

As a further alternative, a non-swelling polymer (e.g. a plastic) may be used in place of the non-swelling and/or non-expanding elastomeric material. The non-swelling polymer can be TEFLON™, RYTON™ or PEEK™.

The elastomeric material may be in the form of a formation. The formation can comprise one or more bands of the elastomeric material, the bands typically being annular. Alternatively, the formation may comprise two outer bands of a non-swelling and/or non-expanding elastomeric material (or other rubber or plastic) with a band of swelling elastomeric material therebetween. A further alternative formation comprises one or more bands of elastomeric material that are more or less covered or encased in a non-swelling and/or non-expanding elastomeric (or other) material. At least a portion of the elastomeric material is typically not covered by the non-swelling and/or non-expanding material. The uncovered portion of the elastomeric material typically facilitates contact between the material and the actuating agent. Other formations may also be used.

The elastomeric material typically swells upon contact with the actuating fluid due to absorption of the fluid by the material. Alternatively, or additionally, the elastomeric material can expand through chemical attack resulting in a breakdown of cross-linked bonds.

The elastomeric material typically expands and/or swells by around 5% to 200%, although values outwith this range are also possible. The expansion and/or swelling of the elastomeric material can typically be controlled. For example, restricting the amount of actuating agent can control the amount of expansion and/or swelling. Also, reducing the amount of elastomeric material that is exposed to the actuating agent (e.g. by covering or encasing more or less of the material in a non-swelling material) can control the amount of expansion and/or swelling. Other factors such as temperature and pressure can also affect the amount of expansion and/or swelling, as can the surface area of the elastomeric material that is exposed to the actuating agent.

Optionally, the expansion and/or swelling of the elastomeric material can be delayed for a period of time. This allows the conduit to be located in the second conduit and radially expanded before the elastomeric material expands and/or swells. Chemical additives can be combined with the base formulation of the swelling elastomeric material to delay the swelling for a period of time. The period of time can be anything from a few hours to a few days. The particular chemical additive that is used typically depends upon the structure of the base polymer in the elastomeric material. Pigments such as carbon black, glue, magnesium carbonate, zinc oxide, litharge and sulphur are known to have a slowing or delaying influence on the rate of swelling.

As an alternative to this, a water or other alkali-soluble material can be used, where the soluble material is at least partially dissolved upon contact with a fluid, or by the alkalinity of the water.

The method typically includes the additional step of applying the elastomeric material to an outer surface of a conduit. The conduit can be any downhole tubular, such as drill pipe, liner, casing or the like. The conduit is preferably capable of being radially expanded, and is thus typically of a ductile material.

The method typically includes the additional step of locating the conduit within a second conduit. The second conduit may comprise a borehole, casing, liner or other downhole tubular.

The method typically includes the additional step of applying a radial expansion force to the conduit. The radial expansion force typically increases the inner and outer diameters of the conduit. The radial expansion force can be applied using an inflatable element (e.g. a packer) or an expander device (e.g. a cone). The conduit can be rested on top of the inflatable element or the expander device as it is run into the second conduit.

The method typically includes the additional steps of providing an expander device and pushing or pulling the expander device through the conduit. The expander device is typically attached to a drill string, coiled tubing string, wireline or the like, but can be pushed or pulled through the second conduit using any conventional means.

Alternatively, the method typically includes the additional steps of providing an inflatable element and actuating the inflatable element. The inflatable element can be attached to a drill string, coiled tubing string or wireline (with a downhole pump). Optionally, the method may include one, some or all of the additional steps of deflating the inflatable element, moving it to another location, and re-inflating it to expand a further portion of the conduit.

The method optionally includes the additional step of injecting or pumping the actuating agent into the borehole.

The method optionally includes the additional step of temporarily anchoring the conduit in place. This provides an anchor point for the radial expansion of the conduit. A packer, slips or the like can be used for this purpose. The inflatable element is optionally used to expand a portion of the conduit against the second conduit to act as an anchor point.

BRIEF DESCRIPTION OF THE DRAWINGS

Embodiments of the present invention shall now be described, by way of example only, with reference to the accompanying drawings, in which.

DETAILED DESCRIPTION

Figure 1:
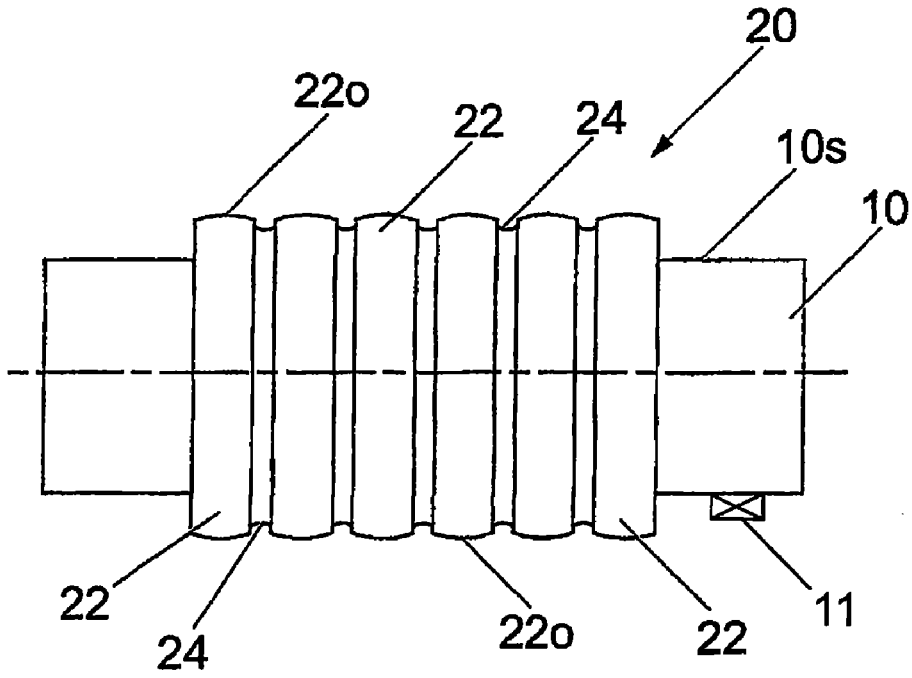
FIG. 1 is a first embodiment of a formation applied to an outer surface of a conduit.

Referring to the drawings, FIG. 1 shows a conduit 10 that is provided with a first embodiment of a formation 20 on an outer surface 10*s* thereof. The formation 20 includes a plurality of bands 22 that are rounded on their outer edges 220 and are joined by a plurality of valleys 24 therebetween. The bands 22 and valleys 24 provide an overall ribbed profile to the formation 20.

Formation 20 is typically comprised of an elastomeric material that can expand and/or swell due to contact with an actuating agent such as a fluid. The expansion and/or swelling of the elastomeric material results in increased dimensional properties of the elastomeric material in the formation 20. That is, the material forming the bands 22 and valleys 24 will expand or swell in both the longitudinal and radial directions, the amount of expansion- or swelling depending on the amount of actuating agent, the amount of absorption thereof by the elastomeric material and the amount of the elastomeric material itself. It will also be appreciated that for a given elastomeric material, the amount of swelling and/or expansion is a function not only of the type of actuating agent, but also of physical factors such as pressure, temperature and the surface area of material that is exposed to the actuating agent.

The expansion and/or swelling of the elastomeric material can take place either by absorption of the actuating agent into the porous structure of the elastomeric material, or through chemical attack resulting in a breakdown of cross-linked bonds. In the interest of brevity, use of the terms "swell" and "swelling" or the like will be understood also to relate to the possibility that the elastomeric material may additionally, or alternatively expand.

The elastomeric material is typically a rubber material, such as NITRILE™, VITON™, AFLAS™, Ethylene-propylene rubbers (EPM or EPDM) and KALREZ™. The actuating agent is typically a fluid, such as hydraulic oil or water, and is generally an oil- or water-based fluid. For example, brine or other production or drilling fluids (e.g. mud) can be used to cause the elastomeric material to swell. The actuating agent used to actuate the swelling of the elastomeric material can either be naturally occurring in the borehole itself, or specific fluids or chemicals that are pumped or injected into the borehole.

The type of actuating agent that causes the elastomeric material to swell generally depends upon the properties of the material, and in particular the hardening matter, material or chemicals used in the elastomeric material.

Table 1 below gives examples of fluid swell for a variety of elastomeric materials, and the extent to which they swell when exposed to certain actuating agents.

TABLE 1

| | Swelling Media (at 300° F.) | |
|---|---|---|
| Material | Expansion with Hydraulic Oil | Expansion With Water |
| NITRILE ™ | 15% | 10% |
| VITON ™ | 10% | 20% |
| AFLAS ™ | 30% | 12% |
| EPDM | 200% | 15% |
| KALREZ ™ | 5% | 10% |

As indicated above, the amount of swelling of the elastomeric material depends on the type of actuating agent used to actuate the swelling, the amount of actuating agent and the amount and type of elastomeric material that is exposed to the actuating agent. The amount of swelling of the elastomeric material can be controlled by controlling the amount of fluid that is allowed to contact the material and for how long. For example, the material may only be exposed to a restricted amount of fluid where the material can only absorb this restricted amount. Thus, swelling of the elastomeric material will stop once all the fluid has been absorbed by the material.

The elastomeric material can typically swell by around 5% (or less) to around 200% (or more), depending upon the type of elastomeric material and actuating agent used. If the particular properties of the material and the amount of fluid that the material is exposed to are known, then it is possible to predict the amount of expansion or swelling. It is also possible to predict how much material and fluid will be required to fill a known volume.

The structure of the formation 20 can be a combination of swelling or expanding and non-swelling or non-expanding elastomers, and the outer surfaces of the formation 20 may be profiled to enable maximum material exposure to the swelling or expanding medium. In the interest of brevity, non-swelling and non-expanding elastomeric material will be referred to commonly by "non-swelling", but it will be appreciated that this may include non-expanding elastomeric materials also.

The formation 20 is typically applied to the outer surface 10*s* of the conduit 10 before it is radially expanded. Conduit 10 can be any downhole conduit that is capable of sustaining plastic and/or elastic deformation, and can be a single length of, for example, liner, casing etc. However, conduit 10 may be formed of a plurality of lengths of casing, liner or the like that are coupled together using any conventional means, e.g. screw threads, welding etc.

Formation 20 is typically applied at axially spaced-apart locations along the length of conduit 10, although it may be provided continuously over the length of the conduit 10 or a portion thereof. It will be appreciated that the elastomeric material will require space into which it can swell, and thus it is preferable to have at least some spacing between the formations 20. The elastomeric material of the or each formation 20 is typically in a solid or relatively solid form so that it can be attached or bonded to the outer surface 10*s* and remain there as the conduit 10 is run into the borehole, casing, liner or the like.

Once the borehole has been drilled, or in the case of a borehole that is provided with pre-installed casing, liner or the like, conduit 10 is located in the borehole, casing, liner or the like and radially expanded using any conventional means. This can be done by using an inflatable element (e.g. a packer) or an expander device (e.g. a cone) to apply a radial expansion force. The conduit 10 typically undergoes plastic and/or elastic deformation to increases its inner and outer diameters.

The expansion of conduit 10 is typically not sufficient to expand the outer surface 10*s* into direct contact with the formation of the borehole or pre-installed casing, liner or the like, although this may not always be the case. For example, certain portions of the conduit 10 may contact the formation at locations along its length due to normal variations in the diameter of the borehole during drilling, and/or variations in the diameter of the conduit 10 itself. Thus, an annulus is typically created between the outer surface 10*s* and the borehole, casing, liner etc.

It will be appreciated that the elastomeric material in the or each formation 20 may begin to swell as soon as the conduit 10 is located in the borehole as the fluid that actuates the swelling may be naturally occurring in the borehole. In this case, there is generally no requirement to inject chemicals or other fluids to actuate the swelling of the elastomeric material.

However, the elastomeric material may only swell when it comes into contact with particular fluids that are not naturally occurring in the borehole and thus the fluid will require to be injected or pumped into the annulus between the conduit 10 and the borehole, casing, liner or the like. This can be done using any conventional means.

As an alternative to this, a bag or other such container (not shown) that contains the actuating fluid can be attached to the outer surface 10*s* at or near to the or each formation 20. Indeed, the bag or the like can be located over the or each formation 20. Thus, as the conduit 10 is radially expanded, the bag ruptures causing the actuating fluid to contact the elastomeric material.

It will be appreciated that it is possible to delay the swelling of the elastomeric material. This can be done by using chemical additives in the base formulation that causes a delay in swelling. The type of additives that may be added will typically vary and may be different for each elastomeric material, depending on the base polymer used in the material. Typical pigments that can be added that are known to delay or having a slowing influence on the rate of swelling include carbon black, glue, magnesium carbonate, zinc oxide, litharge and sulphur.

As an alternative, the elastomeric material can be at least partially or totally encased in a water-soluble or alkali-soluble polymeric covering. The covering can be at least partially dissolved by the water or the alkalinity of the water so that the actuating agent can contact the elastomeric material thereunder. This can be used to delay the swelling by selecting a specific soluble covering that can only be dissolved by chemicals or fluids that are injected into the borehole at a predetermined time.

The delay in swelling can allow the conduit 10 to be located in the borehole, casing, liner or the like and expanded into place before the swelling or a substantial part thereof takes place. The delay in swelling can be any length from hours to days.

As the elastomeric material swells, it expands and thus creates a seal in the annulus. The seal is independent of the diameter of the borehole, casing, liner or the like as the material will swell and continue to swell upon absorption of the fluid to substantially fill the annulus between the conduit 10 and the borehole, casing, liner or the like in the proximity of the formation 20. As the elastomeric material swells and continues to do so, it will come into contact with the formation of the borehole, casing, liner or the like and will go into a compressive state to provide a tight seal in the annulus. Not only does the elastomeric material act as a seal, but it will also tend to lock the conduit 10 in place within the borehole, casing, liner or the like.

Upon swelling, the elastomeric material retains sufficient mechanical properties (e.g. hardness, tensile strength, modulus of elasticity, elongation at break etc) to withstand differential pressure between the borehole and the inside of the liner, casing etc. The mechanical properties that are retained also ensure that the elastomeric material remains bonded to the conduit 10. The mechanical properties can be maintained over a significant time period so that the seal created by the swelling of the elastomeric material does not deteriorate over time.

It will be appreciated that the mechanical properties of the elastomeric material can be adjusted or tuned to specific requirements. Chemical additives such as reinforcing agents, carbon black, plasticisers, accelerators, activators, anti-oxidants and pigments may be added to the base polymer to have an effect on the final material properties, including the amount of swell. These chemical additives can vary or change the tensile strength, modulus of elasticity, hardness and other factors of the elastomeric material.

The resilient nature of the elastomeric material can serve to absorb shocks and impacts downhole, and can also tolerate movement of the conduit 10 (and other downhole tubular members) due to expansion and contraction etc.

Figure 2:
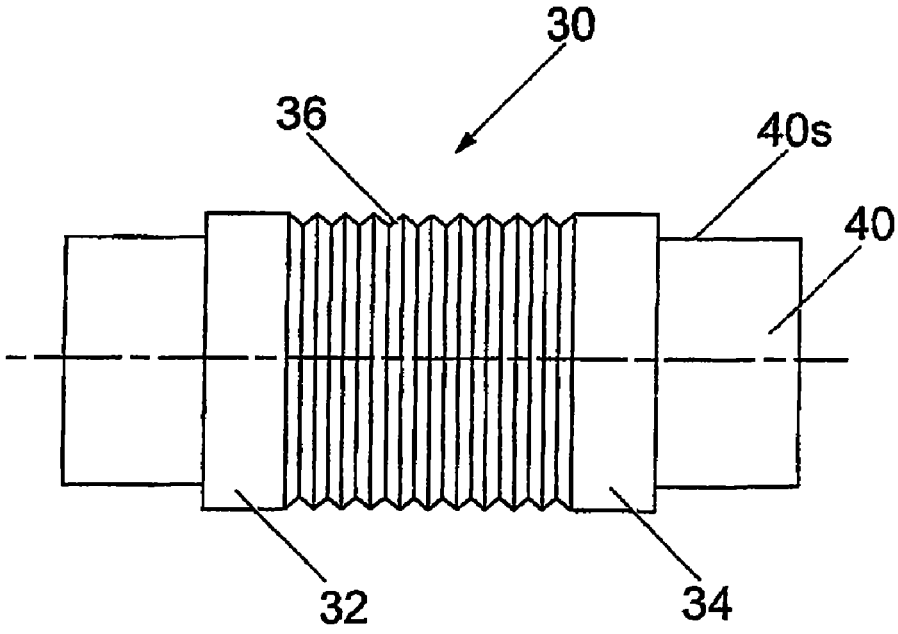
FIG. 2 is a second embodiment of a formation applied to an outer surface of a conduit.

Referring to FIG. 2, there is shown an alternative formation 30 that can be applied to an outer surface 40*s* of a conduit 40. Conduit 40 can be the same or similar to conduit 10. As with formation 20, formation 30 can be applied at a plurality of axially spaced-apart locations along the length of the conduit 40. Conduit 40 may be a discrete length of downhole tubular that is capable of being radially expanded, or can comprise a length of discrete portions of downhole tubular that are coupled together (e.g. by welding, screw threads etc).

The formation 30 comprises two outer bands 32, 34 of a non-swelling elastomeric material with an intermediate band 36 of a swelling elastomeric material therebetween. It will be appreciated that the intermediate band 36 has been provided with a ribbed or serrated outer profile to provide a larger amount of material (i.e. an increased surface area) that is exposed to the actuating fluid that causes swelling. The use of the outer bands 32, 34 of a non-swelling elastomeric material can allow the amount of swelling of the intermediate band 36 of the elastomeric material to be controlled. This is because the two outer bands 32, 34 can limit or otherwise restrict the amount of swelling of the elastomeric material (i.e. band 36) in the axial directions. Thus, the swelling of the material will be substantially constrained to the radial direction.

The non-swelling elastomeric material can be an elastomer that swells in a particular fluid that is not added or injected into the borehole, or is not naturally occurring in the borehole. Alternatively, the non-swelling elastomeric material can be an elastomer that swells to a lesser extent in the naturally occurring, added or injected fluid. For example, and with reference to Table 1 above, if hydraulic oil is being used as the actuating fluid, then the elastomeric material could be EPDM (which expands by around 200% in hydraulic oil) and the non-swelling elastomeric material could be KALREZ™ as this only swells by around 5% in hydraulic oil.

As a further alternative, a non-swelling polymer (e.g. a plastic) may be used in place of the non-swelling elastomeric material. For example, TEFLON™, RYTON™ or PEEK™ may be used.

It will be appreciated that the term "non-swelling elastomeric material" is intended to encompass all of these options.

The outer bands 32, 34 of a non-swelling elastomeric material also provides a mechanism by which the swelling of the elastomeric material in intermediate band 36 can be controlled. For example, when the conduit 10 is radially expanded, the bands 32, 34 of the non-swelling elastomeric material will also expand, thus creating a partial seal in the annulus between the outer surface 10*s* of the conduit 10 and the borehole, casing, liner or the like. The partial seal reduces the amount of fluid that can by-pass it and be absorbed by the swelling elastomeric material of band 36. This restriction in the flow of fluid can be used to delay the swelling of the elastomeric material in band 36 by restricting the amount of fluid that can be absorbed by the material, thus reducing the rate of swelling.

The thickness of the bands 32, 34 in the radial direction can be chosen to allow either a large amount of fluid to seep into band 36 (i.e. by making the bands relatively thin) or a small amount of fluid (i.e. by making the bands relatively thick). If the bands 32, 34 are relatively thick, a small annulus will be created between the outer surface of the bands 32, 34 and the borehole etc, thus providing a restriction to the fluid. The restricted fluid flow will thus cause the elastomeric material to swell more slowly. However, if the bands 32, 34 are relatively thin, then a larger annulus is created allowing more fluid to by-pass it, and thus providing more fluid that can swell the elastomeric material.

Additionally, the two outer bands 32, 34 can also help to prevent extrusion of the swelling elastomer material in band 36. The swelling elastomeric material in band 36 typically gets softer when it swells and can thus extrude. The non-swelling material in bands 32, 34 can help to control and/or prevent the extrusion of the swelling elastomeric material. It will be appreciated that the bands 32, 34 reduce the amount of space into which the swelling material of band 36 can extrude and thus by reducing the space into which it can extrude, the amount of extrusion can be controlled or substantially prevented. For example, if the thickness of the bands 32, 34 is such that there is very little or no space into which the swelling elastomeric material can extrude into, then this can stop the extrusion. Alternatively, the thickness of the bands 32, 34 can provide only a relatively small space into which the swelling elastomeric material can extrude into, thus substantially controlling the amount of extrusion.

Figure 3A:
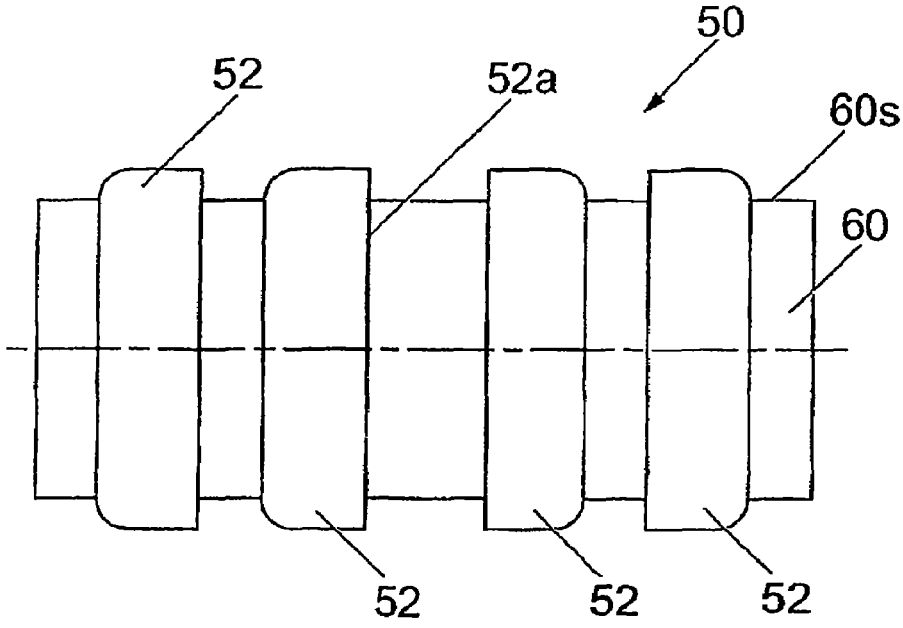
FIG. 3*a* is a third embodiment of a formation applied to an outer surface of a conduit.
Figure 3B:
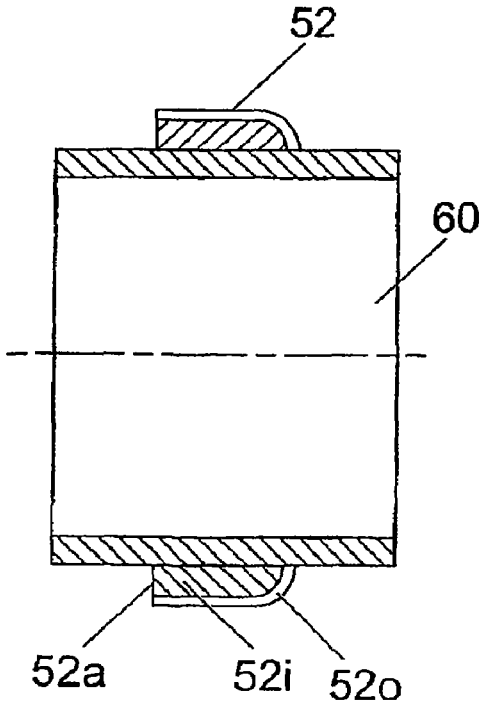
FIG. 3*b* is a cross-sectional view through a portion of the conduit of FIG. 3*a*.

FIGS. 3*a* and 3*b* show a further formation 50 that can be applied to an outer surface Gos of a conduit 60. Conduit 60 can be the same as or similar to conduits 10, 40 and may be a discrete length of downhole tubular that is capable of being radially expanded, or can comprise a length of discrete portions of downhole tubular that are coupled together (e.g. by welding, screw threads etc).

Formation 50 comprises a number of axially spaced-apart bands 52 that are typically annular bands, but this is not essential. The bands 52 are located symmetrically about a perpendicular axis so that the seals created upon swelling of the elastomeric material within the bands hold pressure in both directions.

The bands 52 are typically lip-type seals. As can be seen from FIG. 3*b* in particular, the bands 52 have an outer covering 52*o* of a non-swelling elastomer, and an inner portion 52*i* of a swelling elastomeric material. One end 52*a* of the band 52 is open to fluids within the borehole, whereas the outer covering 52*o* encases the remainder of the elastomeric material, thus substantially preventing the ingress of fluids.

The swelling of the elastomeric material in inner portion 52*i* is constrained by the outer covering 52*o*, thus forcing the material to expand out end 52*a*. This creates a seal that faces the direction of pressure. With the embodiment shown in FIG. 3*a*, four seals are provided, with two facing in a first direction and two facing in a second direction. The second direction is typically opposite the first direction. This provides a primary and a back-up seal in each direction, with the seal facing the pressure.

The outer covering 52*o* can also help to prevent or control the extrusion of the elastomeric material in inner portion 52*i* as described above.

Thus, certain embodiments of the present invention provide apparatus and methods for creating seals in a borehole that use the swelling properties of elastomeric materials to create the seals. Certain embodiments of the present invention can also prevent swelling of the material until the conduit to which it is applied has been radially expanded in situ. Modifications and improvements may be made to the foregoing without departing from the scope of the present invention.

The invention claimed is:

1. A seal for use in a borehole, the seal comprising:

an elastomeric material that is capable of expanding or swelling upon contact with an actuating agent, wherein the elastomeric material is applied to an outer surface of a conduit and wherein the conduit has a first diameter prior to expansion and a second larger diameter after expansion; and a soluble material disposed around the elastomeric material, wherein the soluble material is configured to at least partially dissolve upon contact with a fluid.

2. The seal according to claim 1, wherein the elastomeric material comprises a rubber.

3. The seal according to claim 1, wherein the elastomeric material is selected from the group consisting of NITRILE™, VITON™, AFLAS™, Ethylene-propylene rubbers and KALREZ™.

4. The seal according to claim 1, wherein the actuating agent is selected from the group consisting of a water-based oil, a water, a mineral-based oil and a mineral-based water.

5. The seal according to claim 1, wherein the actuating agent is naturally occurring downhole.

6. The seal according to claim 1, wherein the elastomeric material is applied at at least two axially spaced-apart locations on the conduit.

7. The seal according to claim 1, wherein the elastomeric material can expand through chemical attack resulting in a breakdown of cross-linked bonds.

8. A method of creating a seal in a borehole, the method comprising:

providing an elastomeric material in the borehole;

exposing the material to an actuating agent that causes the elastomeric material to expand; and controlling the direction of expansion of the elastomeric material, wherein the direction is controlled by an outer cover that covers a portion of the elastomeric material and wherein the cover is a non-swelling elastomeric material band that encases a top portion and a side portion of the elastomeric material.

9. The method according to claim 8, including the additional step of applying the elastomeric material to an outer surface of a conduit.

10. The method according to claim 9, including the additional step of locating the conduit within a second conduit.

11. The method according to claim 9, wherein the method includes the additional step of applying a radial expansion force to the conduit.

12. The method according to claim 8, wherein the method includes the additional step of injecting the actuating agent into the borehole.

13. The method according to claim 8, wherein the direction is controlled by a pair of non-swelling elastomeric material bands disposed on each side of the elastomeric material.

14. A sealing apparatus for isolating a tubular, comprising:

an expandable tubular body;

one or more swelling elastomers disposed around an outer surface of the expandable tubular body; and an outer cover disposed on a portion of each swelling elastomer, wherein the outer cover is configured to control the direction of swelling as the swelling elastomer expands and wherein the outer cover is a non-swelling elastomeric material band that encases a top portion and a side portion of the elastomeric material.

15. The apparatus according to claim 14, wherein the one or more swelling elastomers are activated by a wellbore fluid.

16. The apparatus according to claim 14, wherein the one or more swelling elastomers include at least one hydrocarbon activated swelling elastomer and at least one water activated swelling elastomer.

17. The apparatus according to claim 14, wherein the outer cover is a non-swelling elastomer.

18. A method for isolating a well, comprising:

running a sealing apparatus into the wellbore, the sealing apparatus including:

a tubular body; and a swelling element disposed around an outer surface of the tubular body; and expanding the sealing apparatus to allow the swelling element to contact the wellbore as the swelling element swells.

19. The method according to claim 18, including the additional step of controlling the direction of swelling.

20. The method according to claim 19, wherein the direction of swelling is controlled by a cover disposed on a side of the swelling element.

21. A sealing apparatus for isolating a tubular, comprising:

a tubular body;

one or more swelling elastomers disposed around an outer surface of the tubular body, wherein each elastomer is a band having an outer surface, an inner surface, a first end surface and a second end surface and wherein the inner surface of the band is in contact with the tubular body; and a lip-type seal disposed adjacent each swelling elastomer, wherein the lip-type seal is configured to control the direction of swelling as the swelling elastomer expands and wherein the lip-type seal is positioned adjacent the first end surface and not the second end surface.

22. The apparatus according to claim 21, wherein the lip-type seal is an elastomer.

23. A seal for use in a borehole, the seal comprising:

an elastomeric material that is capable of expanding or swelling upon contact with an actuating agent, wherein the elastomeric material is applied to an outer surface of a conduit and wherein a container of the actuating agent is located near the elastomeric material such that the container bursts upon radial expansion of the conduit; and a soluble material disposed around the elastomeric material, wherein the soluble material is configured to at least partially dissolve upon contact with a fluid.

24. A seal for use in a borehole, the seal comprising:

an elastomeric material that is capable of expanding or swelling upon contact with an actuating agent, wherein the elastomeric material is applied to an outer surface of a conduit and wherein the conduit is radially expanded; and a soluble material disposed around the elastomeric material, wherein the soluble material is configured to at least partially dissolve upon contact with a fluid.

25. The seal according to claim 24, wherein the conduit is located in a second conduit before being radially expanded.

26. A method of creating a seal in a borehole, the method comprising:

positioning a tubular body having a swelling elastomer in the borehole, wherein the swelling elastomer is a band having an outer surface, an inner surface, a first end surface and a second end surface and wherein the inner surface of the band is in contact with the tubular body;

exposing the swelling elastomer to an actuating agent that causes the swelling elastomer to expand; and controlling the direction of expansion of the swelling elastomer by a lip-type seal disposed adjacent the swelling elastomer, wherein the lip-type seal is positioned adjacent the first end surface and not the second end surface.

27. A sealing apparatus for isolating a tubular, comprising:

a tubular body;

a swelling elastomer disposed around the tubular body, wherein the elastomer is a band having an outer surface, an inner surface, a first end surface and a second end surface and wherein the inner surface of the band is in contact with the tubular body; and a lip-type seal disposed adjacent the swelling elastomer, wherein the lip-type seal is configured to control the direction of swelling as the swelling elastomer expands and wherein the lip-type seal is positioned adjacent the first end surface and not the second end surface.

28. The apparatus according to claim 27, wherein the lip-type seal is an elastomer.

* * * * *